US010418740B2

(12) United States Patent
Kimura et al.

(10) Patent No.: US 10,418,740 B2
(45) Date of Patent: Sep. 17, 2019

(54) TERMINAL MODULE

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Akio Kimura, Mie (JP); Seidou Nishijima, Mie (JP)

(73) Assignees: AutoNetworks Technologies, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 16/086,326

(22) PCT Filed: Mar. 7, 2017

(86) PCT No.: PCT/JP2017/009008
§ 371 (c)(1),
(2) Date: Sep. 19, 2018

(87) PCT Pub. No.: WO2017/163858
PCT Pub. Date: Sep. 28, 2017

(65) Prior Publication Data

US 2019/0103695 A1 Apr. 4, 2019

(30) Foreign Application Priority Data

Mar. 24, 2016 (JP) ..... 2016-060202
Dec. 22, 2016 (JP) ..... 2016-249297

(51) Int. Cl.
*H01R 13/24* (2006.01)
*H01R 13/187* (2006.01)

(52) U.S. Cl.
CPC ..... *H01R 13/2421* (2013.01); *H01R 13/187* (2013.01)

(58) Field of Classification Search
CPC ... H01R 13/2421; H01R 13/24; H01R 13/187
See application file for complete search history.

(56) References Cited

U.S. PATENT DOCUMENTS 5,871,379 A 2/1999 Tanaka et al.
5,993,245 A * 11/1999 Osada ..... H01R 4/4836 439/441

(Continued)

FOREIGN PATENT DOCUMENTS

JP 7-211383 8/1995
JP 10-27639 1/1998

(Continued)

OTHER PUBLICATIONS

International Search Report of Jun. 13, 2017.

*Primary Examiner* — Briggitte R. Hammond
(74) *Attorney, Agent, or Firm* — Gerald E. Hespos; Michael J. Porco; Matthew T. Hespos

(57) ABSTRACT

A terminal fitting (50) includes a metal case (52) having an opening (52A) through which a mating contact point (31) is inserted, a coil spring (16) accommodated in the metal case (52), and an electrical contact (53) biased toward the opening (52A) by the coil spring (16) and configured to move while compressing the coil spring (16) by being pressed by the mating contact point (31). The metal case (52) includes a first guide (parts at both front and rear sides of an opening (57) in a front wall (55) of the metal case (52)) configured to guide the electrical contact (53) to a position shifted from a position before a movement in a direction orthogonal to an inserting direction of the mating contact point (31) by sliding in contact with the electrical contact (53) when the (Continued)

electrical contact (53) moves by being pressed by the mating contact point (31).

10 Claims, 18 Drawing Sheets

(56) References Cited

U.S. PATENT DOCUMENTS

| | | | | |
|---|---|---|---|---|
| 6,494,748 | B1 | 12/2002 | Mori et al. | |
| 6,554,640 | B1 * | 4/2003 | Koike | H01R 13/6315 429/97 |
| 6,932,620 | B2 * | 8/2005 | Ishiguro | H01Q 1/1271 439/66 |
| 7,621,785 | B2 * | 11/2009 | Lin | H01R 9/18 439/553 |
| 7,736,202 | B1 * | 6/2010 | Kaiser | H01R 13/2421 439/824 |
| 8,668,529 | B2 * | 3/2014 | Park | H01R 12/714 439/700 |
| 2011/0306251 | A1 | 12/2011 | Mulfinger et al. | |
| 2018/0316113 | A1 * | 11/2018 | Nishida | H01R 4/4872 |
| 2018/0316115 | A1 * | 11/2018 | Kimura | H01R 13/2442 |
| 2018/0323528 | A1 * | 11/2018 | Kimura | H01R 13/2421 |

FOREIGN PATENT DOCUMENTS

| | | |
|---|---|---|
| JP | 63-99683 | 6/1998 |
| JP | 2002-274290 | 9/2002 |
| JP | 2011-143802 | 7/2011 |

* cited by examiner

TERMINAL MODULE

BACKGROUND

Field of the Invention

This specification relates to a terminal module.

Related Art

A known method establishes electrical connection between facing contact points in an automotive vehicle or the like by butting and bringing the facing contact points into contact. In such a method, adhesion of foreign substances between the contact points causes a conduction failure and is not preferable. Japanese Unexamined Patent Publication No. 2002-274290 eliminates foreign substances between contact points by causing the contact points to slide on each other when the contact points are butted against each other.

The power supply device of Japanese Unexamined Patent Publication No. 2002-274290 has end plates facing each other and a coil spring sandwiched and compressed between the end plates in a case of a female junction. The end plate on a side exposed to the outside is provided with a resilient leaf spring. This leaf spring has an oblique free end part resiliently deformable by being folded after extending out from the end plate, and a male contact point and a female contact point slide on each other when contacting each other However, the configuration of Japanese Unexamined Patent Publication No. 2002-274290 cannot be utilized for large-current applications. This is because a thickness of the leaf spring becomes large to enhance rigidity for large-current applications. However, the folded part cannot be deformed and the free end is not easy to deform resiliently. Thus, the free end part cannot be deformed resiliently and slide when contacting the male contact point. Hence, foreign substances are not eliminated.

This specification discloses a terminal module with an enhanced ability to remove foreign substances between a contact point and a mating contact point even if a current value increases and a plate thickness increases.

SUMMARY

A terminal module disclosed in this specification includes a case having an opening through which a mating contact point is to be inserted. A resilient member is accommodated in the case, and an electrical contact is biased toward the opening by the resilient member. The resilient member is configured to be pressed by the mating contact and to move while compressing the resilient member. The case includes a first guide configured to guide the electrical contact to a position shifted from a position before a movement in a direction orthogonal to an inserting direction of the mating contact point by sliding in contact with the electrical contact member when the electrical contact member moves by being pressed by the mating contact point.

According to the above-described terminal module, the electrical contact member is guided to the position shifted from the position before the movement in the direction orthogonal to the inserting direction of the mating contact point. Thus, a shifting phenomenon occurs so that the mating contact point rubs the electrical contact. Thus, any foreign substances that adhere to a surface of the electrical contact member to be contacted by the mating contact point and any foreign substances that adhere to the mating contact point are scraped off. In this way, the electrical contact member need not be deformed resiliently to scrape off foreign substances according to the above terminal module. Thus, a plate thickness of the electrical contact member can be increased according to a current value.

Further, the first guide portion may linearly guide the electrical contact to an oblique front side with respect to the inserting direction. According to the above-described terminal module, the electrical contact is guided linearly to the oblique front side with respect to the inserting direction of the mating contact point. Thus, a frictional force between the electrical contact and the mating contact point is substantially uniform while the electrical contact member and the mating contact point are relatively shifted. Thus, foreign substances can be scraped off substantially uniformly.

The case may include a second guide that is configured to guide the electrical contact to the position before the movement by sliding in contact with the electrical contact member when the electrical contact guided to the shifted position is biased toward the opening by the resilient member. According to the above terminal module, when the electrical contact member and the mating contact point are brought out of contact for maintenance or another reason, the electrical contact member is guided by the second guide portion to return to the position before the movement (position before the movement by being pressed by the mating contact point). Thus, the shifting phenomenon also occurs when the electrical contact member and the mating contact point are brought into contact again. That is, foreign substances can be scraped off also when the terminal module and the mating contact point are brought into contact for a second time or more.

The first guide and the second guide may be substantially parallel. Accordingly, a forward movement of the electrical contact in the inserting direction of the mating contact point and a rearward movement of the electrical contact member in the inserting direction can be converted into movements of the electrical contact member in the direction orthogonal to the inserting direction without waste.

An interval in the direction orthogonal to the inserting direction between the first and second guides at a movement end position of the electrical contact in the inserting direction may be wider than an interval in the direction orthogonal to the inserting direction between the first and second guides at the position of the electrical contact before the movement. For example, if a movement of the electrical contact in the direction orthogonal to the inserting direction of the mating contact point is restricted by the first and second guides when the electrical contact member is pressed by the mating contact point and located at the movement end position in the inserting direction of the mating contact point, the electrical contact cannot follow a movement of the mating contact point and a deviation occurs at touching points if the mating contact point moves in the direction orthogonal to the inserting direction of the mating contact point due to thermal contraction or the like. If this is repeated, so-called fretting wear occurs and electrical resistance at the touching points may increase to generate heat.

According to the above-described terminal module, the interval in the direction orthogonal to the inserting direction of the mating contact point between the first and second guides at the movement end position is wider than the interval in the direction orthogonal to the inserting direction between the first and second guides at the position of the electrical contact member before the movement. Thus, if the mating contact point moves in the orthogonal direction, the electrical contact member can follow the movement of the mating contact point. Accordingly, a deviation is less likely to occur at the touching points and fretting wear can be suppressed.

The first and second guides may be provided on inner wall surfaces of a guide hole provided in a side wall of the case. Additionally, the electrical contact member may include a protruding portion inserted in the guide hole and configured to slide in contact with the first and second guide portions. Accordingly, a front side of the first guide portion in the inserting direction of the mating contact point and a front side of the second guide portion in the inserting direction are coupled via the side wall of the case and a rear side of the first guide in the inserting direction of the mating contact point and a rear side of the second guide in the inserting direction are coupled via the side wall of the case. Thus, the first and second folded portions are not likely to be opened in the direction orthogonal to the inserting direction of the mating contact point by a sliding-contact force of the protruding portion.

The first guide may include a first folded portion protruding from the inner wall surface and bent at 90° or more, and the protruding portion may slide in contact with the first folded portion. Accordingly, the protruding portion can be guided more smoothly by sliding in contact with that curved surface.

The second guide may include a second folded portion protruding from the inner wall surface and bent at 90° or more, and the protruding portion may slide in contact with the second folded portion. Accordingly, the protruding portion can be guided more smoothly by sliding in contact with that curved surface.

The terminal module may include an intermediate terminal to be connected to an external device, and the electrical contact member may be connected to the intermediate terminal by a flexible braided wire. Accordingly, a guided movement of a slide-contact part to a position shifted in the above orthogonal direction is not likely to be hindered by a connection structure to the external device.

According to the terminal disclosed in this specification, it is possible to remove foreign substances between a contact point and a mating contact point even if a current value increases and a plate thickness increases.

DETAILED DESCRIPTION

First Embodiment

A first embodiment is described with reference to FIGS. 1 to 8. In the following description, a vertical direction and a lateral direction are based on a vertical direction and a lateral direction in FIG. 1. Further, a front-rear direction is based on a direction perpendicular to the plane of FIG. 1, wherein a side in front of the plane is referred to as a front and a side behind the plane is referred to as a rear.

(1-1) Connector

Figure 1:
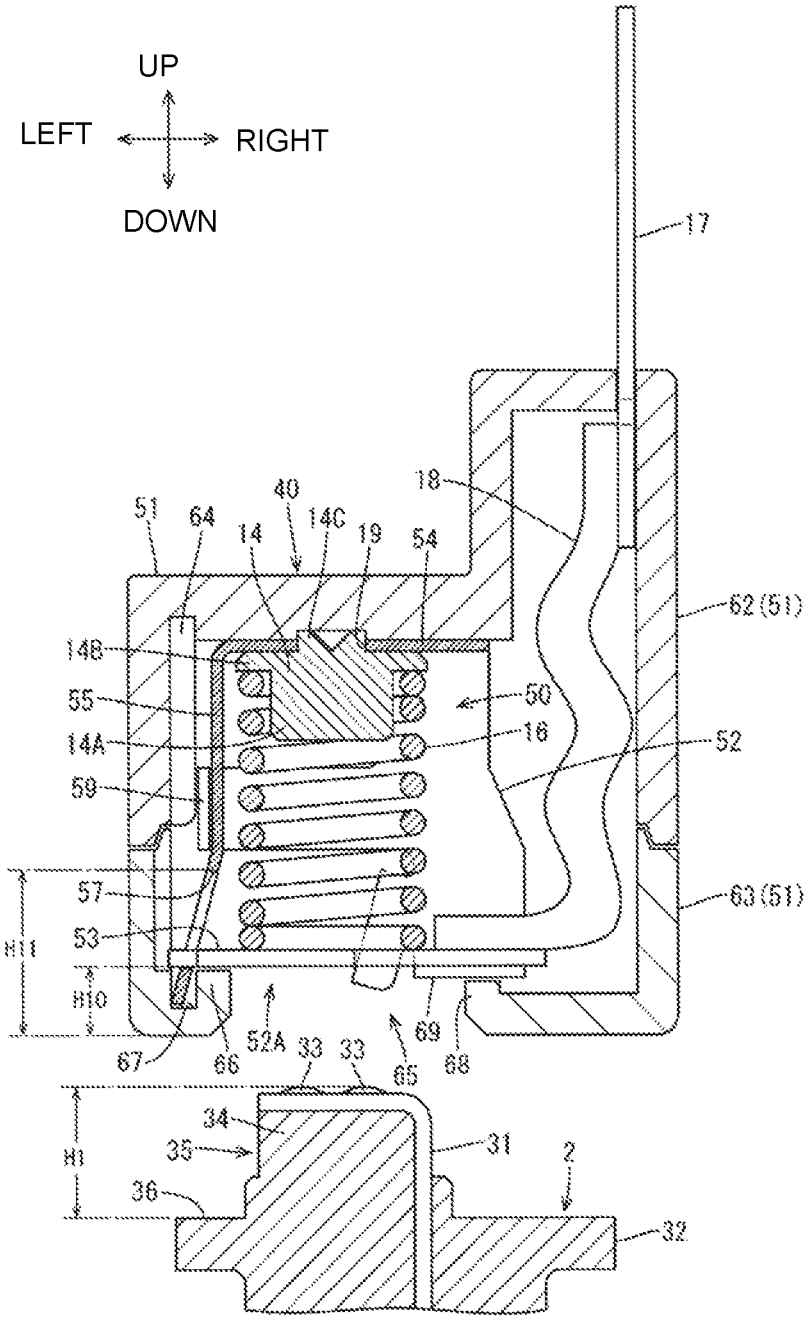
FIG. 1 is a section of a connector and a mating connector according to a first embodiment (section along B-B of FIG. 3 when a terminal fitting is singly viewed).

As shown in FIG. 1, a connector 40 is fit and connected electrically to a mating connector 2 and includes a terminal fitting 50 (an example of a terminal module) and a housing 51 for accommodating the terminal fitting 50.

(1-1-1) Terminal Fitting

The terminal fitting 50 includes a metal case 52, a cylindrical spring receiving portion 14 crimped to a ceiling wall 54 of the metal case 52, a plate-like electrical contact 53, a coil spring 16 (an example of a resilient member) accommodated in the metal case 52 while being compressed by the spring receiving portion 14 and the electrical contact 53, an intermediate terminal 17 and a braided wire 18 conductively connecting the intermediate terminal 17 and the electrical contact 53.

Figure 2:
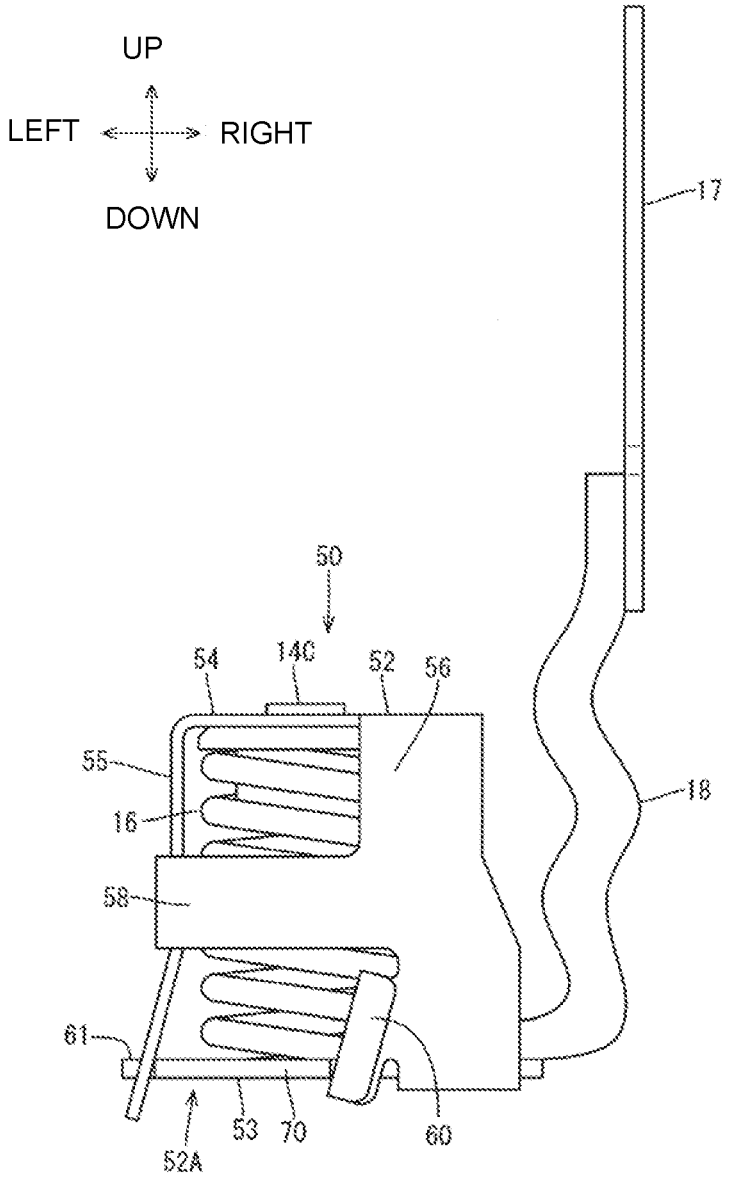
FIG. 2 is a side view of the terminal fitting viewed from front.

As shown in FIG. 2, the metal case 52 is formed by press-working a metal plate material, such as an SUS material and is formed into a substantially box shape by the ceiling wall 54, a front wall 55 extending down from a left side of the ceiling wall 54, and two side walls 56 extending down from both front and rear sides of a right part of the ceiling wall 54 and parallel to each other. An opening 52A is formed on the lower side and can receive a mating contact point 31 (see FIG. 1).

Figure 3:
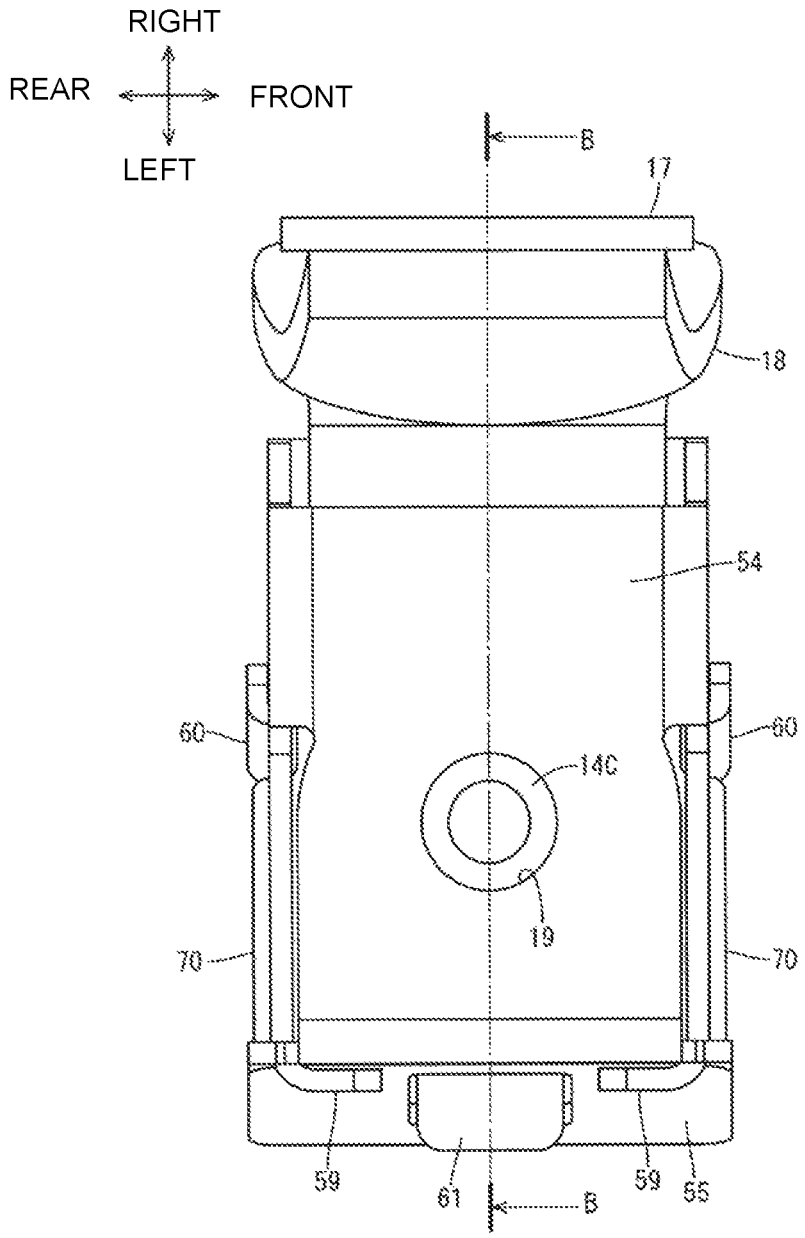
FIG. 3 is a top view of the terminal fitting.

As shown in FIGS. 1 and 3, a crimping hole 19 penetrates through the ceiling wall 54 and the spring receiving portion 14 is to be crimped thereto.

Figure 4:
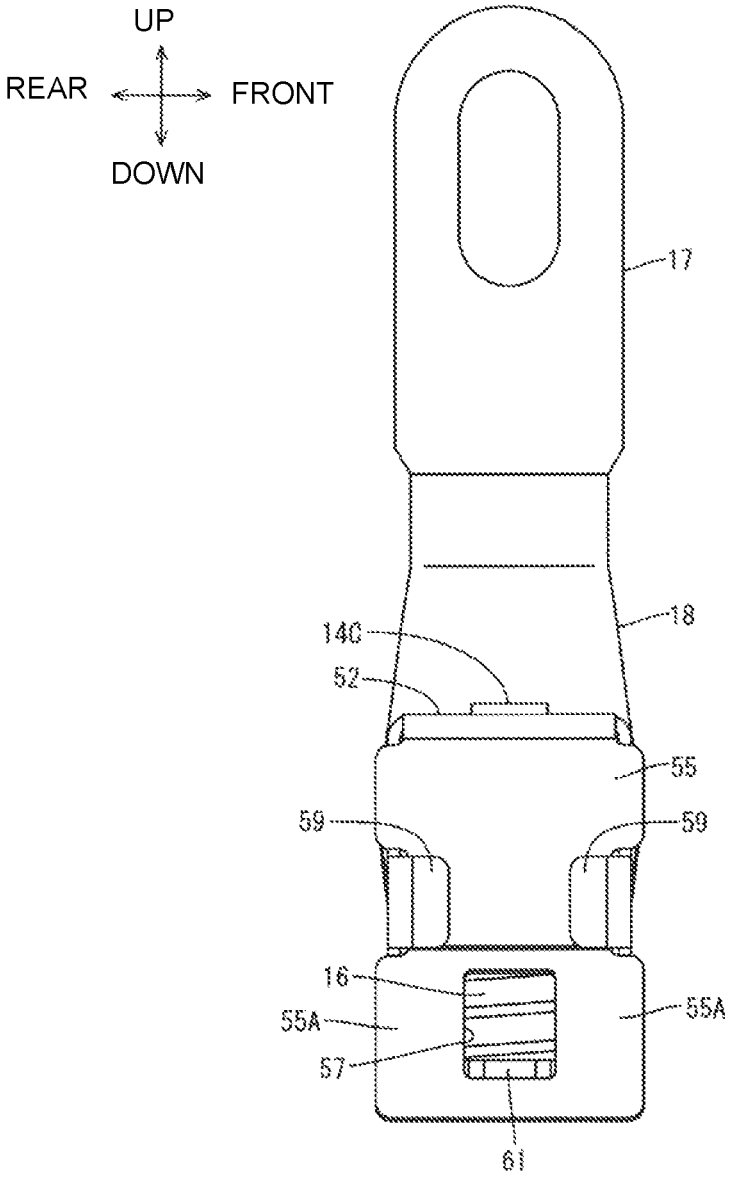
FIG. 4 is a front view of the terminal fitting viewed from left.

As shown in FIG. 1, a lower part of the front wall 55 is bent slightly leftward on a side slightly below a vertical center. Further, as shown in FIG. 4, a substantially rectangular opening 57 is formed on the bent lower end part of the front wall 55.

Parts 55 at both front and rear sides of the opening 57 in the front wall 55 constitute first guides for guiding slide-contact parts of the electrical contact 53 when the electrical contact 53 is pressed and moved by the mating contact point 31. More specifically, the first guides (i.e. parts 55A at both front and rear sides of the opening 57) slide in contact with the electrical contact 53 to guide the electrical contact 53 to a position shifted from a position before a horizontal movement (an example of a direction orthogonal to an inserting direction of the mating contact point).

As shown in FIG. 2, the side wall 56 includes a front wall holding portion 58 extending left from a substantially vertical center thereof. As shown in FIG. 4, the front wall holding portion 58 includes a locking portion 59 extending further leftward than the front wall 55 and folded in substantially at 90°. The front wall 55 is prevented by the locking portions 59 from being turned left and opened about an upper end thereof.

Further, as shown in FIG. 2, a part of the side wall 56 below the front wall holding portion 58 includes a part protruding left, and that protruding part is folded out at 180° along a folding line inclined at the same angle as an angle of inclination of the lower end part of the front wall 55, thereby forming a folded portion 60.

The folded portion 60 constitutes a second guide for guiding the slide-contact part of the electrical contact member 53 when the electrical contact member 53 is biased by the coil spring 16 to move toward the opening 52A. More specifically, the second guide (i.e. folded portion 60) slides in contact with the electrical contact member 53 to guide the electrical contact member 53 to the position before the movement (position shown in FIG. 2).

As shown in FIG. 2, the parts 55A (i.e. first guides) at both front and rear sides of the opening 57 of the front wall 55 and the folded portions 60 (i.e. second guides) are substantially parallel, and an interval in the horizontal direction (an example of the direction orthogonal to the inserting direction of the mating contact point) between the parts 55A at both front and rear sides of the opening 57 of the front wall 55 and the folded portions 60 substantially matches a lateral width of later-described second protruding portions 70 of the electrical contact 53 at an arbitrary position of a movable range of the electrical contact 53 in the vertical direction (an example of the inserting direction of the mating contact point).

Figure 5:
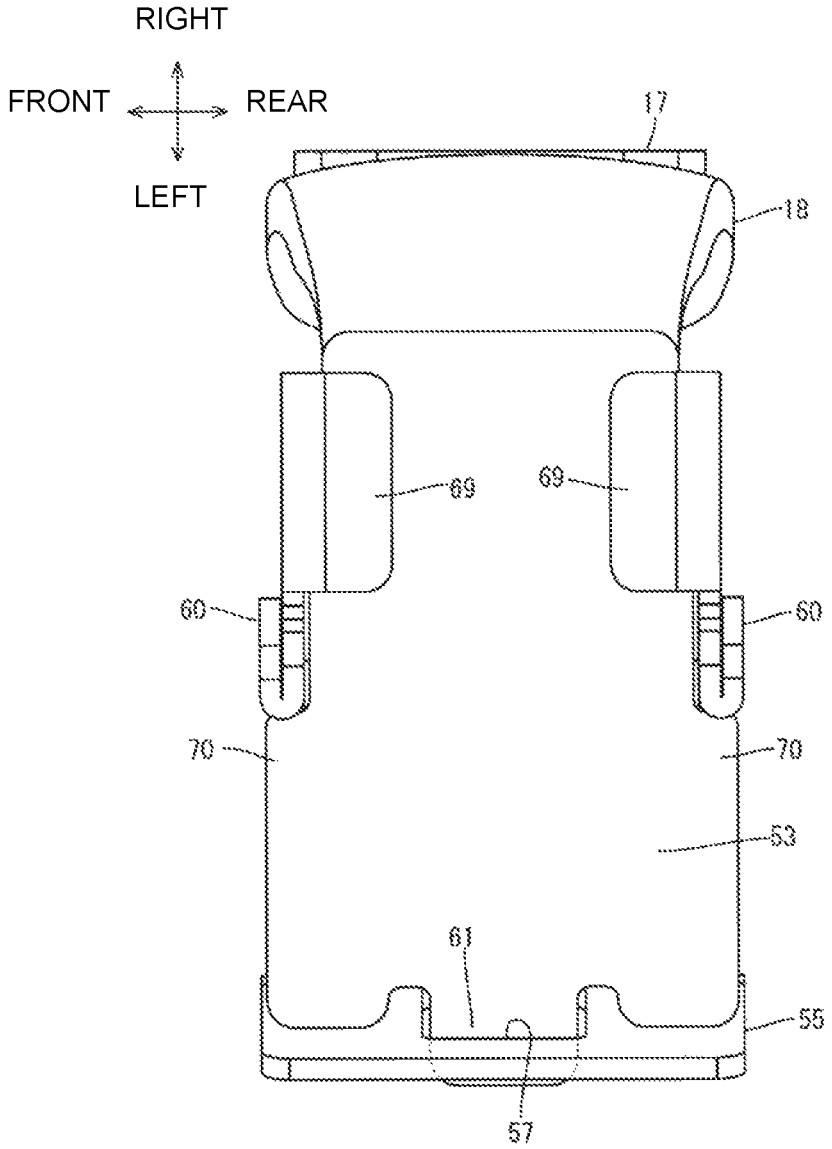
FIG. 5 is a bottom view of the terminal fitting.

Further, as shown in FIG. 5, lower end parts of the side walls 56 are bent in at 90°, thereby providing supports 69 for supporting the electrical contact 53 from below. The position of the upper surfaces of the supports 69 and the position of a lower side of the opening 57 are substantially aligned in the vertical direction.

The spring receiving portion 14 is made of metal, such as brass, includes, as shown in FIG. 1, a shaft 14A accommodated inside the coil spring 16, a flange 14B annularly protruding from an upper end of the shaft 14A and a cylindrical projection 14C provided on the upper surface of the shaft 14A, and is crimped to the crimping hole 19 of the ceiling wall 54 by the projection 14C being struck and caulked from above.

Substantially one winding of the coil spring 16 is in contact with each of the flange 14B of the spring receiving portion 14 and the electrical contact 53, and the coil spring 16 biases the electrical contact 53 toward the opening 52A. A length of the shaft 14A of the spring receiving portion 14 according to this embodiment is about ⅓ of the length of the coil spring 16, and a lower part of the coil spring 16 is allowed to buckle to a certain extent when the coil spring 16 is compressed.

The electrical contact 53 is formed by press-working a metal plate material, such as copper alloy, and is oriented to be perpendicular to a center axis of the coil spring 16. A plate thickness of the electrical contact 53 is set depending on a capacitance required for the terminal fitting 50, and the electrical contact 53 has a plate thickness and hardness to be regarded as a rigid body as compared to the coil spring 16.

As shown in FIG. 5, the electrical contact member 53 has the lower surface thereof exposed to the outside of the metal case 52 through the opening 52A on the lower side of the metal case 52. Further, as shown in FIGS. 2 and 5, a first protrusion 61 protrudes leftward on a left edge of the electrical contact 52, and inserted into the opening 57 of the front wall 55. A width of the first protruding portion 61 in the front-rear direction is equal to or slightly smaller than a width of the opening 57 in the front-rear direction.

The second protrusions 70 are provided on both front and rear sides of a left part of the electrical contact member 53 and protrude in the front-rear direction. The second protrusions 70 are located between the lower end part of the front wall 55 of the metal case 52 and the folded portions 60. A width of each second protrusion 70 in the lateral direction is equal to or slightly smaller than an interval between the front wall 55 of the metal case 52 and the folded portions 60 in the lateral direction.

As shown in FIGS. 2 and 4, the intermediate terminal 17 is in the form of a flat plate and is disposed outside the metal case 52.

As shown in FIG. 2, the braided wire 18 has both ends connected to a lower part of the intermediate terminal 17 and a right part of the electrical contact member 53 by resistance welding, crimping or the like. The braided wire 18 is formed by braiding conductive metal strands made of copper, and is flexible. An intermediate part of the braided wire 18 is disposed outside the metal case 52 in such a state as to have an extra length. The braided wire 18 is deflected and deformed when the intermediate terminal 17 and the electrical contact member 53 relatively move. Thus, the braided wire 18 does not hinder movements when the intermediate terminal 17 and the electrical contact member 53 relatively move.

(1-1-2) Housing

As shown in FIG. 1, the housing 51 is configured by combining an upper divided body 62 and a lower divided body 63 made of synthetic resin and vertically divided. A right part of an upper wall of the upper divided body 62 protrudes up, and the lower end part of the intermediate terminal 17 is accommodated in a space inside that protruding part. Further, the upper divided body 62 is formed with steps 64 on both front and rear sides of the inner surface of a left wall. A leftward movement of the metal case 52 is restricted by the contact of the locking portions 59 of the front wall holding portions 58 with the steps 64.

The lower divided body 63 is provided with an opening 65 for allowing the entrance of the mating contact point 31. The opening 65 is provided substantially at the same position as the opening 52A on the lower side of the terminal fitting 50, can expose the electrical contact 53 to a lower side, and enables the entrance of a fitting 35 of the mating connector 2.

Further, the lower divided body 63 is formed with a step 66 projecting up on a left edge of the opening 65, and a lower part of the front wall 55 of the metal case 52 is accommodated in a recess 67 between the step 66 and a left wall of the lower divided body 63. Further, the lower divided body 63 also is formed with a step 68 projecting up on a right edge of the opening 65, and the step 68 is substantially in contact with the supports 69 of the metal case 52.

(1-2) Mating Connector

As shown in FIG. 1, the mating connector 2 to be connected to the connector 40 includes the mating contact point 31 and a mating housing 32 made of synthetic resin.

The mating contact point 31 is made of conductive metal and is formed into a substantially L-shape by bending a vertical plate-like member leftward at a substantially right angle. Two spherical portions 33 are arranged side by side in the lateral direction and are formed by being struck from below on the upper surface of the part of the mating contact point 31 bent at a substantially right angle. These two spherical portions 33 are located within a circle defined by a diameter of the coil spring 16 when the connector 40 and the mating connector 2 are connected.

The mating contact 31 is held in the mating housing 32 by insert molding. The mating housing 32 includes a projection 34 to be fit to the connector 40, and the mating contact 31 is held by the projection 34. A part of the projection 34 above a lower edge position (part corresponding to a height H1 in FIG. 1) constitutes the fitting 35. A flange 36 projects out at the lower edge position of the fitting 35. The flange 36 contacts the lower surface of the housing 51, thereby suppressing the insertion of the mating contact point 31 into the connector 40 beyond a predetermined position.

The connector 40 and the mating connector 2 are positioned in the front-rear and lateral directions by unillustrated positioning portions, and the connector 40 and the mating connector 2 can relatively move only in the vertical direction in a state positioned by the positioning portions.

(1-3) Relationship of Terminal Fitting, Housing and Mating Connector

As shown in FIG. 1, the lower side of the opening 57 of the front wall 55 of the metal case 52 is at a position higher than the upper end of the left step 66, and any further downward movement of the electrical contact 53 is restricted by the contact of the first protrusions 61 with the lower side of the open 57 and the contact of the front and rear sides of the right part with the upper surfaces of the supports 69.

An interval H10 from the lower side of the opening 57 to the lower end of the housing 51 (in other words, an interval from the upper surfaces of the supports 69 to the lower end of the housing 51) is smaller than the height H1 of the fitting 35 of the mating connector 2. Thus, when the fitting 35 of the mating connector 2 is inserted through the opening 65, a tip thereof contacts with the lower surface of the electrical contact 53. The electrical contact 53 moves up when the fitting 35 is pushed further.

An interval H11 from the upper side of the opening 57 to the lower end of the housing 51 is larger than the height H1 of the fitting 35 of the mating connector 2. Thus, the electrical contact 53 still has a margin for upward movements even when the fitting 35 of the mating connector 2 is inserted completely.

(1-4) Functions of Terminal Fitting and Connector

Figure 6:
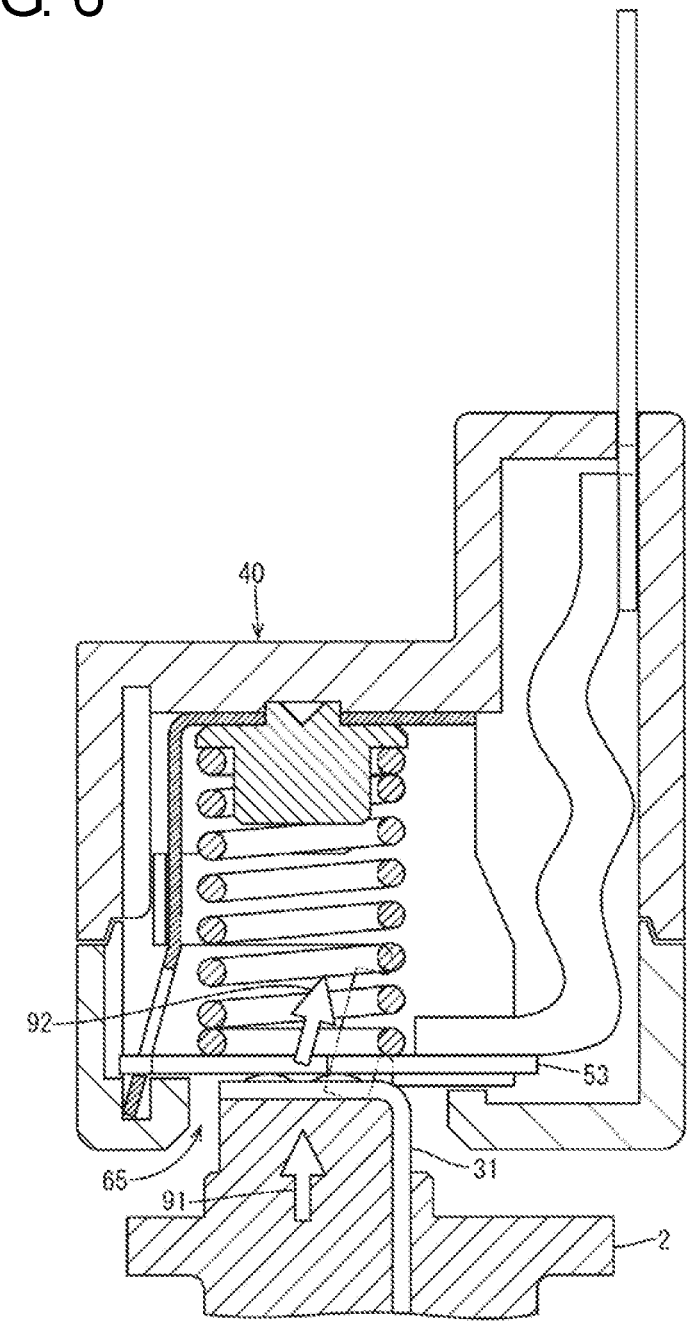
FIG. 6 is a section showing the connector and the mating connector in a state where a mating contact point is in contact with an electrical contact member.

As shown in FIG. 6, when the connector 40 and the mating connector 2 approach each other in the vertical direction as indicated by an arrow 91, the mating contact point 31 of the mating connector 2 is inserted through the opening 65 of the housing 51 and the opening 52A of the metal case 52 and butts against the electrical contact member 53.

When the connector 40 and the mating connector 2 further approach each other, the electrical contact 53 is pressed by the mating contact point 31 and moves up while compressing the coil spring 16. At this time, the slide-contact parts (parts on both front and rear sides of the left edge part of the electrical contact 53 across the first protrusion 61) of the electrical contact 53 slide in contact with the lower part (specifically, a surface of the lower part facing inwardly of the metal case 52) of the front wall 55 of the metal case 52, thereby being guided to positions shifted right (an example of the direction orthogonal to the inserting direction of the mating contact point 31) from the positions before a movement as indicated by an arrow 92. More specifically, the slide-contact parts are guided linearly to an oblique right-upper side (an example of an oblique front side with respect to the inserting direction of the mating contact point 31). In this way, the electrical contact 53 slides right while moving up.

Figure 7:
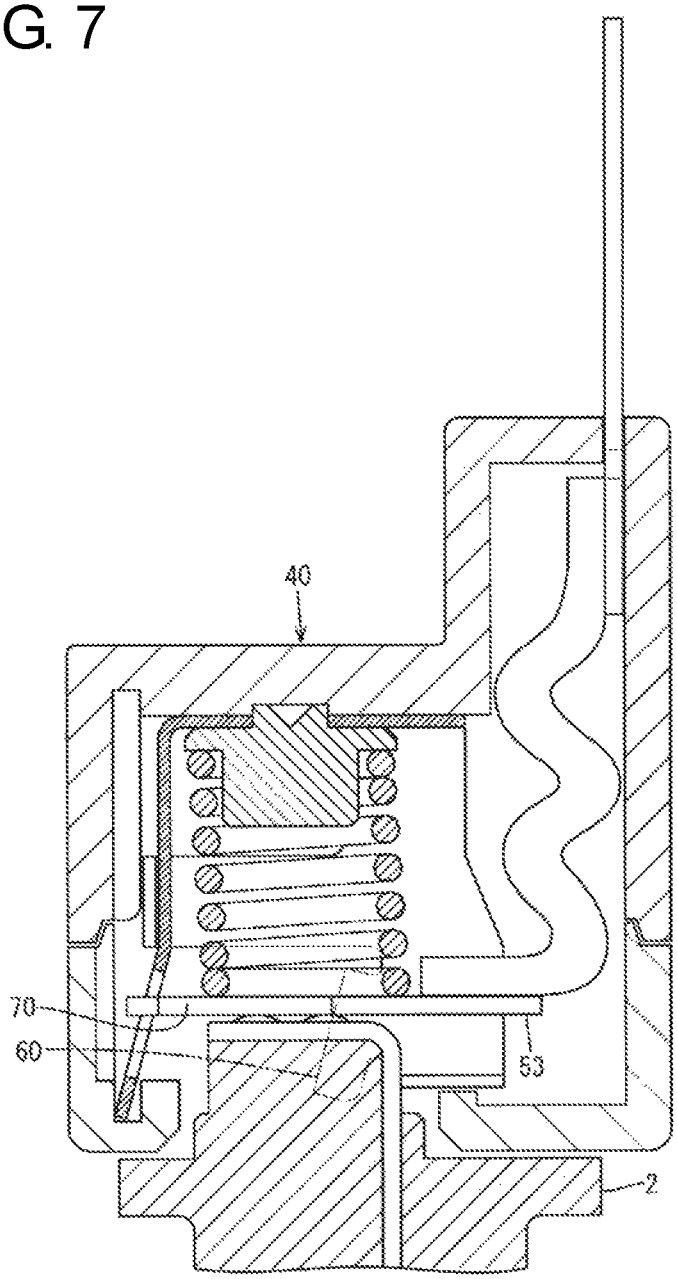
FIG. 7 is a section showing the connector and the mating connector in a connected state.

When the connector 40 and the mating connector 2 further approach each other, as shown in FIG. 7, the connector 40 and the mating connector 2 are connected. In this state, the electrical contact 53 is sandwiched by a biasing force of the coil spring 16 and a pressing force of the mating contact point 31. By pressing the electrical contact member 53 toward the mating contact point 31 by the coil spring 16 in this way, the electrical contact 53 and the mating contact point 31 are connected electrically.

Figure 8:
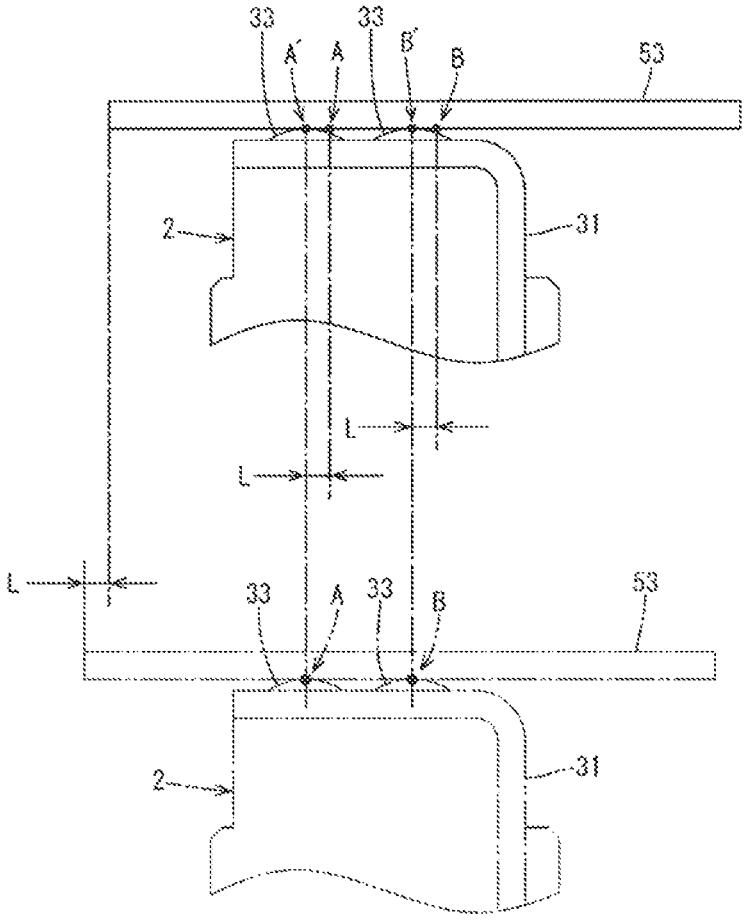
FIG. 8 is a schematic diagram showing a deviation between the mating contact point and the electrical contact member.

With reference to FIG. 8, the positions of the electrical contact 53 in the lateral direction before and after the connection are described. Here, FIG. 8 shows a state where the electrical contact 53 is slid rightward a distance L from a state before the connection. In FIG. 8, points A and B indicate touching positions of the electrical contact member 53 with the respective spherical portions 33 before the connection shown in FIG. 6, and points A' and B' indicate touching positions of the electrical contact member 53 with the respective spherical portions 33 after the connection shown in FIG. 7. If the electrical contact 53 slides rightward the distance L, the respective spherical portions 33 are shifted the distance L to rub the lower surface of the electrical contact 53.

The shifting distance L of the electrical contact 53 and the spherical portions 33 is proportional to the angle of inclination of the lower end part of the front wall 55. Thus, the lower part of the front wall 55 may be more inclined when it is desired to make the distance L longer. Further, since the distance L also is proportional to an upward moving distance of the electrical contact 53, the upward moving distance of the electrical contact 53 may be made longer when it is desired to make the distance L longer.

When the connector 40 and the mating connector 2 connected as shown in FIG. 7 are disconnected for maintenance or another reason (i.e. when the electrical contact 53 and the mating contact point 31 are brought out of contact), the right ends (another example of the slide-contact part) of the second protrusions 70 of the electrical contact 53 slide in contact with the folded portions 60, thereby being guided to positions shifted leftward (direction opposite to the shifting direction at the time of connection) from positions before disconnection. Thus, the electrical contact 53 returns to an initial position in the lateral direction. More specifically, the electrical contact 53 is guided linearly toward an oblique left-lower side (an example of a direction inclined with respect to the inserting direction of the mating contact point) by the folded portions 60 and pressed by the mating contact point, and returns to the position before the upward movement (i.e. position before the movement).

(1-5) Effects of Embodiment

According to the terminal fitting 50 according to the first embodiment, the slide-contact parts (i.e. parts on both front and rear sides of the left part of the electrical contact 53 across the first protrusion 61) of the electrical contact 53 are guided to the positions shifted right from the positions before the movement by the lower end of the front wall 55, such a shifting phenomenon that the spherical portions 33 of the mating contact point 31 rub the electrical contact 53 occurs. Thus, even if foreign substances adhere to the lower surface of the electrical contact 53 or the spherical portions 33 of the mating contact point 31, those foreign substances are scraped off. As just described, according to the terminal fitting 50, the electrical contact 53 need not be deformed resiliently to scrape off foreign substances, wherefore the plate thickness of the electrical contact 53 used can be increased according to a current value.

The slide-contact parts are guided linearly to the oblique right-upper side (i.e. oblique front side with respect to the inserting direction of the mating contact point) in FIG. 6. Thus, a frictional force between the electrical contact 53 and the mating contact point 31 is substantially uniform while the electrical contact 53 and the mating contact point 31 are relatively shifted. Thus, foreign substances can be scraped off substantially uniformly.

When the electrical contact 53 and the mating contact 31 are brought out of contact for maintenance or another reason, the electrical contact 53 is guided by the second guides to return to the position before the movement. Thus, the shifting phenomenon also occurs when the electrical contact 53 and the mating contact point 31 are brought into contact again. That is, foreign substances can be scraped off also when the terminal fitting 50 and the mating contact point 31 are brought into contact for a second time or more.

The parts 55A (first guides) at both front and rear sides of the opening 57 in the front wall 55 and the folded portions 60 (second guides) are substantially parallel. Thus, upward (forward in the inserting direction of the mating contact point 31) and downward movements of the electrical contact 53 can be converted into movements of the electrical contact 53 in the horizontal direction without waste.

Since the electrical contact 53 is connected to the intermediate terminal 17 by the flexible braided wire 18, it can be suppressed that guided movements of the slide-contact parts to the positions shifted in the lateral direction are hindered by a connection structure to an external device.

The folded portions 60 have curved surfaces by being bent at 90° or more. Thus, the right ends of the second protrusions 70 slide in contact with the curved surfaces when the connector 40 and the mating connector 2 are disconnected. Thus, the right ends of the second protrusions 70 can be guided more smoothly.

Second Embodiment

A second embodiment is described with reference to FIGS. 9 to 15.

(2-1) Connector

Figure 9:
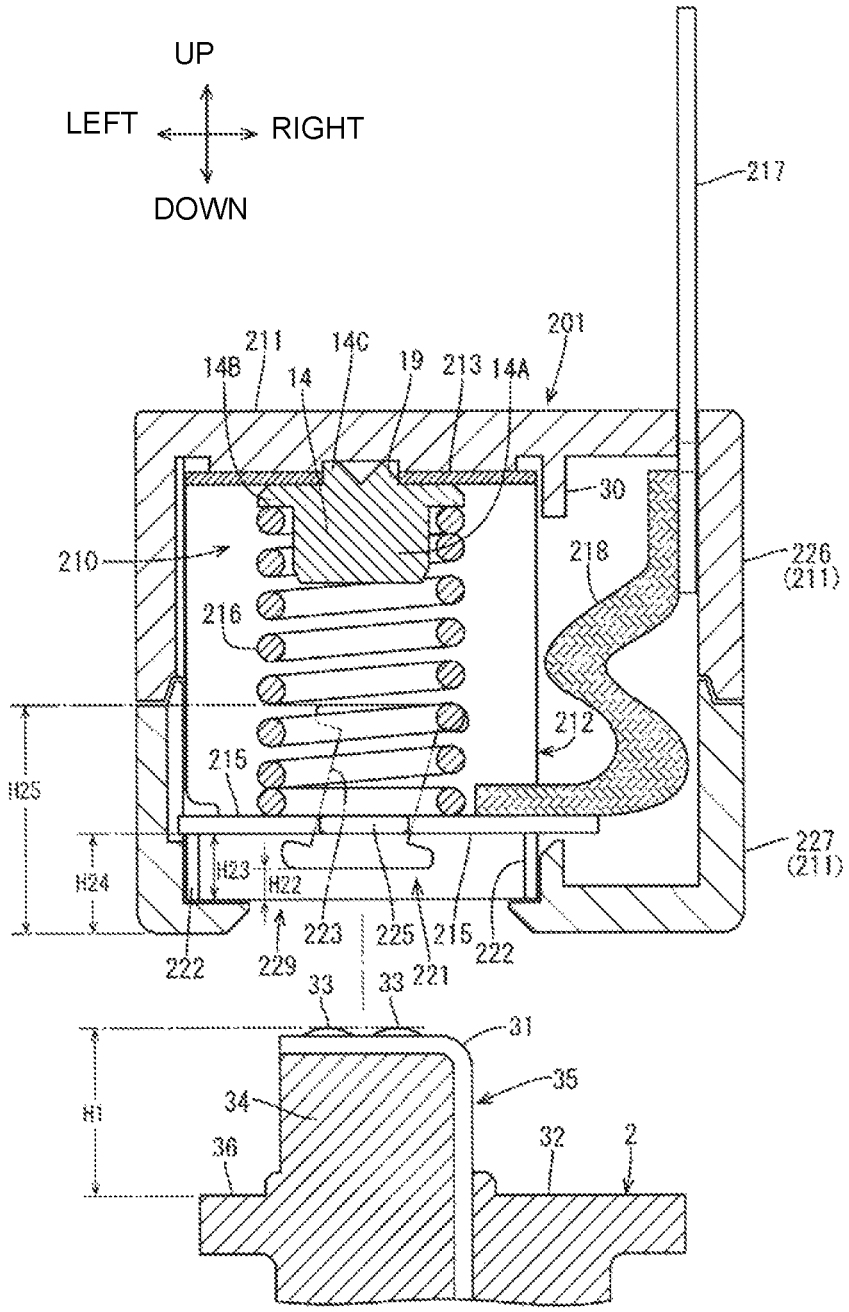
FIG. 9 is a section of a connector and a mating connector according to a second embodiment.

As shown in FIG. 9, a connector 201 according to the second embodiment also is fit and connected electrically to a mating connector 2 and includes a terminal fitting 210 (an example of a terminal module) and a housing 211 for accommodating the terminal fitting 210.

(2-1-1) Terminal Fitting

The terminal fitting 210 includes a metal case 212, a spring receiving portion 14, an electrical contact 215, a coil spring 216, an intermediate terminal 217 and a braided wire 218.

Figure 10:
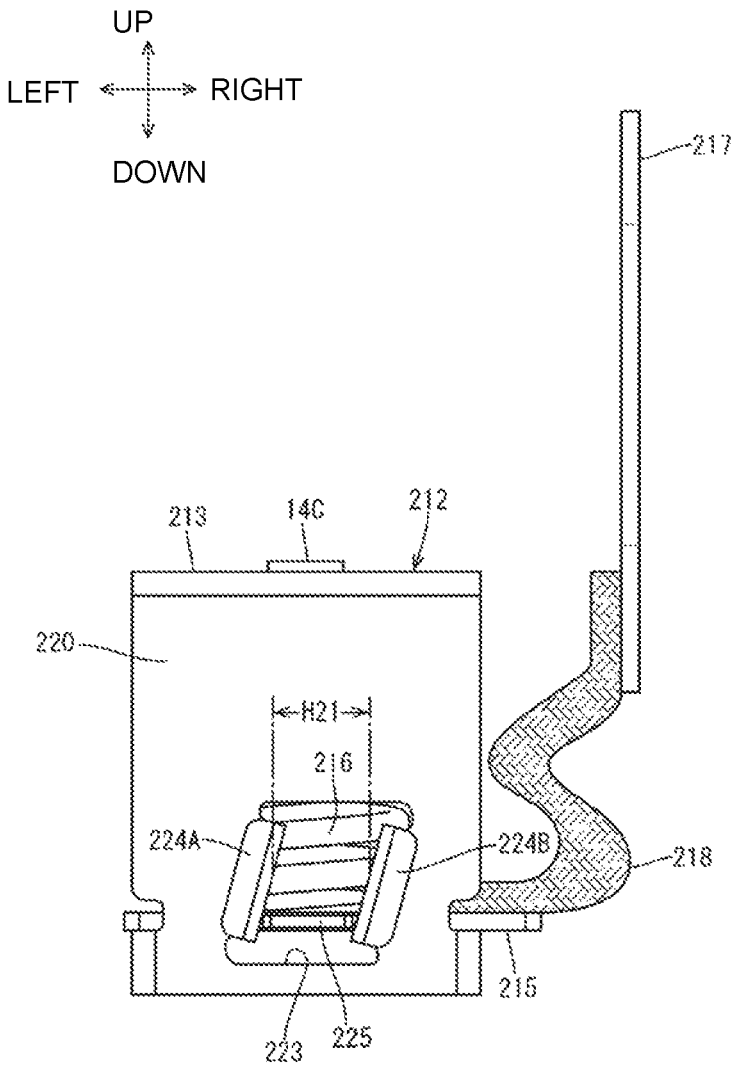
FIG. 10 is a side view of a terminal fitting viewed from front.
Figure 11:
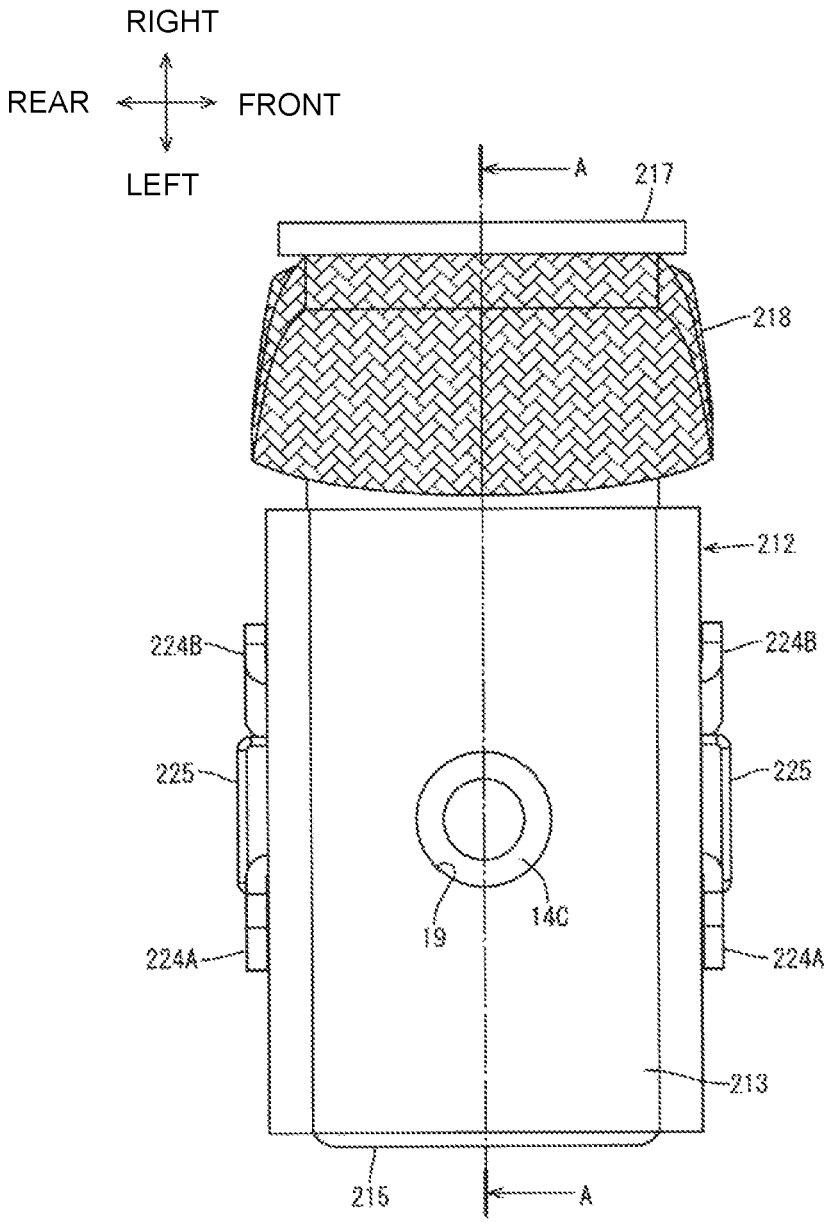
FIG. 11 is a top view of the terminal fitting.
Figure 12:
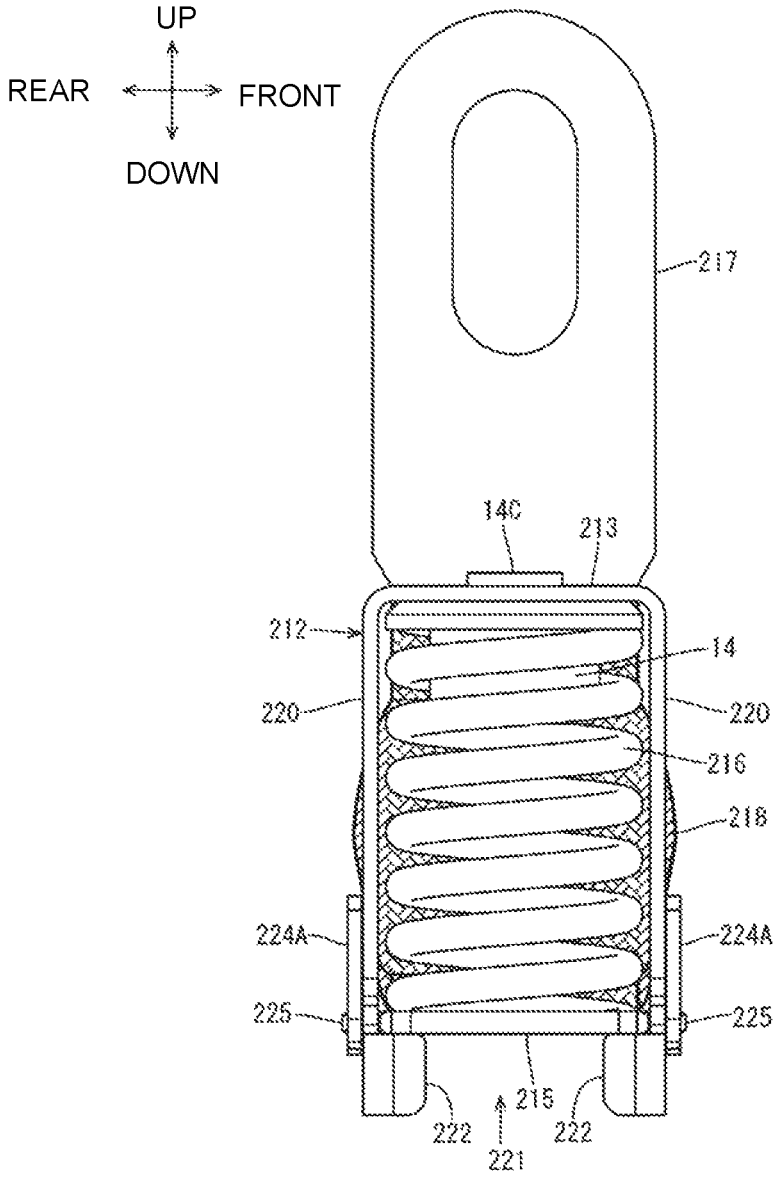
FIG. 12 is a front view of the terminal fitting viewed from left.

As shown in FIGS. 10 to 12, the metal case 212 is formed by press-working a metal plate material, such as a SUS material, and is formed into a substantially box shape with a ceiling wall 213 and two side walls 220 extending down from both front and rear ends of the ceiling wall 213 and parallel to each other, and includes openings on left, right and lower sides. The opening 221 (see FIG. 12) on the lower side is an example of an opening through which a mating contact point 31 (see FIG. 1) is to be inserted.

Figure 13:
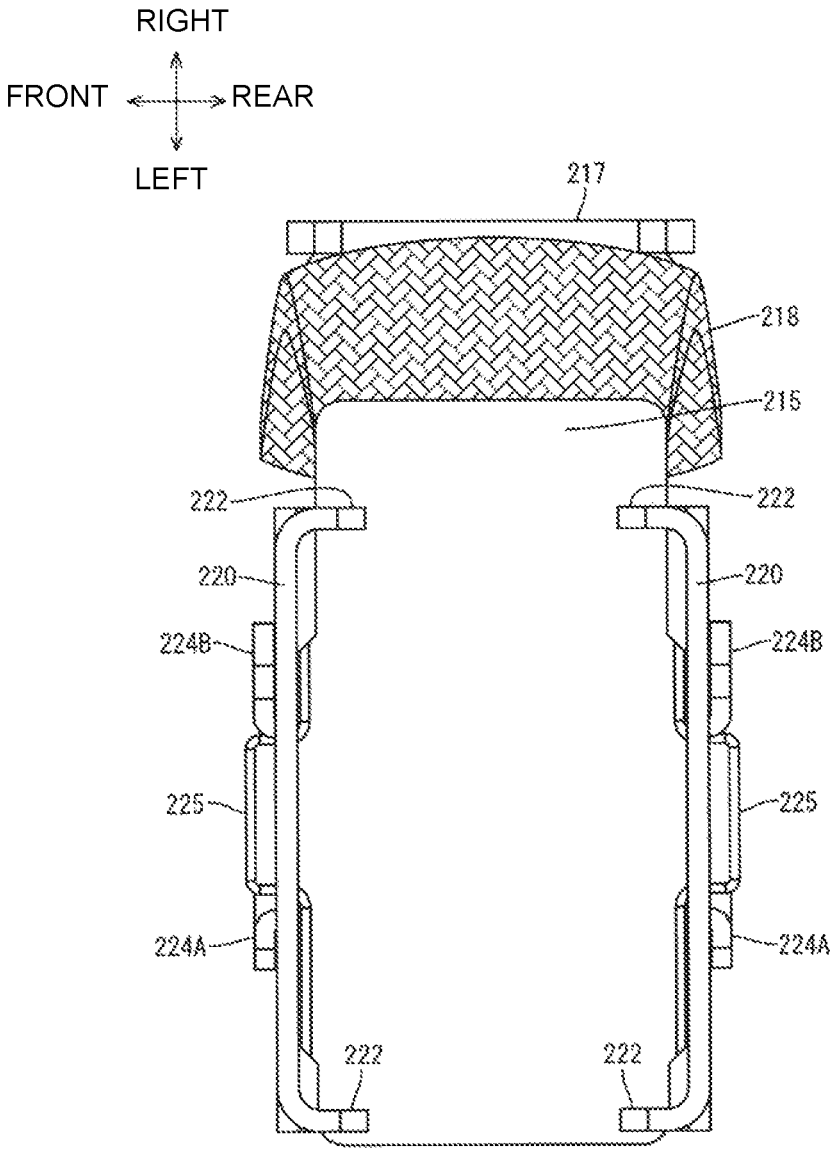
FIG. 13 is a bottom view of the terminal fitting.

As shown in FIGS. 9 and 13, supports 222 for supporting the electrical contact member 215 from below are provided on both left and right sides of lower end parts of the side walls 220. The supports 222 on the left side are formed by bending parts protruding left from the lower ends of the side walls 220 inward of the metal case 212 substantially at 90°. The same applies also to the right supporting portions 222.

As shown in FIG. 10, the side wall 220 is provided with a guide hole 223 having a parallelogram shape with two upper and lower sides extending in a lateral direction and parallel to each other and two left and right sides inclined with respect to a vertical direction and parallel to each other. As shown in FIGS. 10 and 11, the side wall 220 is formed with a first folded portion 224A (an example of the first guide) and a second folded portion 224B (an example of the second guide) by folding parts protruding from two inner walls constituting the aforementioned inclined two sides of the guide hole 223 toward the other inner wall surfaces along folding lines inclined at the same angle as an angle of inclination of the aforementioned inclined two sides.

As shown in FIG. 10, the first and second folded portions 224A, 224B are substantially parallel and an interval H21 in a horizontal direction (an example of the direction orthogonal to the inserting direction of the mating contact point) between the first and second folded portions 224A, 224B substantially matches a width of a later-described protrusion 225 of the electrical contact 215 in the lateral direction at an arbitrary position in a vertical (an example of the inserting direction of the mating contact point) movable range of the electrical contact 215.

Note that the folded portions may be bent at 90° or more and may not necessarily be bent at 180°.

As shown in FIG. 9, the electrical contact 215 is formed by press-working a metal plate material, such as copper alloy, and is oriented to be perpendicular to a center axis of the coil spring 216. A plate thickness of the electrical contact 215 is set depending on a capacitance required for the terminal fitting 210, and the electrical contact 215 has a plate thickness and hardness to be regarded as a rigid body as compared to the coil spring 216.

As shown in FIGS. 9 and 13, the electrical contact 215 has the lower surface exposed to the outside of the metal case 212 through the opening 221 on the lower side of the metal case 212. Further, two protrusions 225 protruding in a front-rear direction are provided on both front and rear sides of the electrical contact member 215, and those protrusions 225 are inserted into the guide holes 223 of the side walls 220. A width of the protrusion 225 in the lateral direction is equal to or slightly smaller than an interval between the two folded portions 224A, 224B of the guide hole 223.

(2-1-2) Housing

As shown in FIG. 9, the housing 211 roughly has the same shape as the housing 51 according to the first embodiment and is configured by combining an upper divided body 226 and a lower divided body 227 made of synthetic resin and vertically divided. The lower divided body 227 according to the second embodiment also provided with an opening 229 for allowing the entrance of the mating contact point 31. The opening 229 is provided substantially at the same position as the opening 221 on the lower side of the terminal fitting 210, can expose the electrical contact 215 to a lower side and enables the entrance of a fitting 35 of the mating connector 2.

(2-2) Relationship of Terminal Fitting, Housing and Mating Connector

As shown in FIG. 9, an interval H22 from the lower side of the guide hole 223 to the lower end of the side wall 220 is smaller than a width (height) H23 of the supporting portion 222 in the vertical direction. Thus, the protrusions 225 of the electrical contact 215 are not in contact with the lower sides of the guide holes 223 and any further vertical movement of the electrical contact member 215 is restricted by the contact of parts of the electrical contact 215 near four corners with the supporting portions 222.

An interval H24 from the upper surface of the support 222 to the lower end of the housing 211 is smaller than a height H1 of the fitting of the mating connector 2 in the vertical direction. Thus, when the fitting 35 of the mating connector 2 is inserted through the opening 221, a tip part thereof comes into contact with the lower surface of the electrical contact 215. When the fitting 35 is pushed farther, the electrical contact 215 moves up.

Further, an interval H25 from the upper side of the opening 223 to the lower end of the housing 211 is larger than the height H1 of the fitting 35 of the mating connector 2 in the vertical direction. Thus, the electrical contact 215 still has a margin for upward movements even in a state where the fitting 35 of the mating connector 2 is inserted completely.

(2-3) Functions of Terminal Fitting

Figure 14:
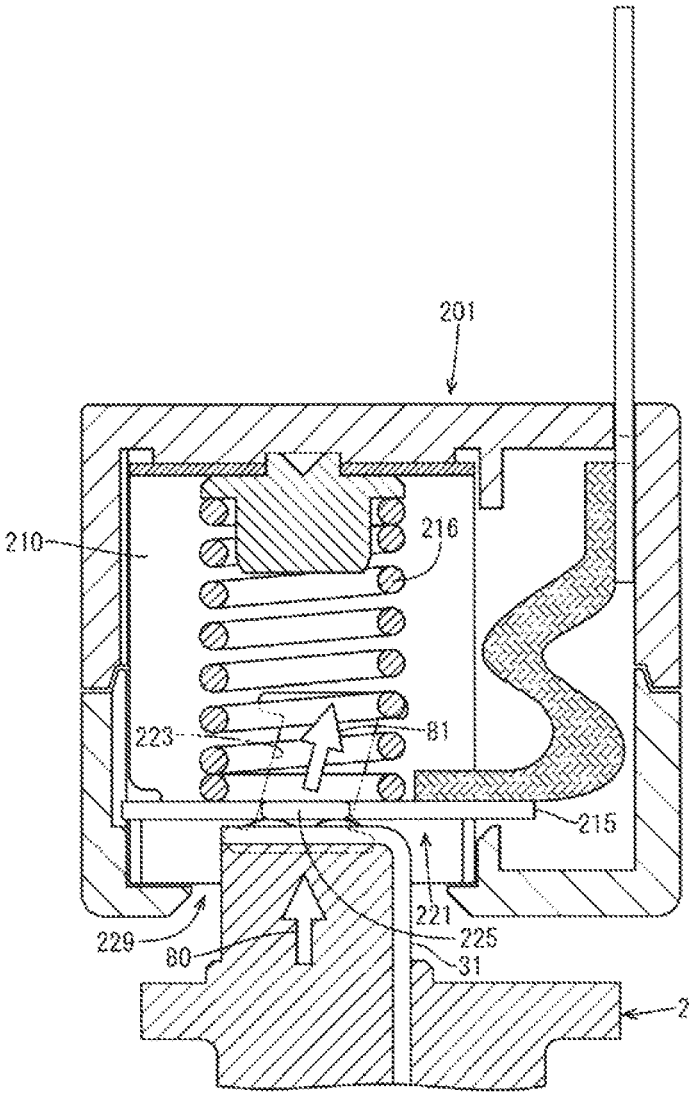
FIG. 14 is a section showing the connector and the mating connector in a state where a mating contact point is in contact with an electrical contact member.

As shown in FIG. 14, when the connector 201 and the mating connector 2 approach each other in the vertical direction, as indicated by an arrow 80, the mating contact point 31 is inserted through the opening 229 of the housing 211 and the opening 221 of the metal case 212 and butts against the electrical contact 215.

When the connector 201 and the mating connector 2 approach each other, the electrical contact 215 is pressed by the mating contact point 31 and moves up while compressing the coil spring 216. At this time, left ends (an example of a slide-contact part) of the protrusions 255 of the electrical contact 215 slide in contact with the first folded portions 224A (first guide) of the guide holes 223. Thus, slide-contact parts are guided linearly to an oblique right-upper side, as indicated by an arrow 81. In this way, the electrical contact 215 slides right while moving up.

Figure 15:
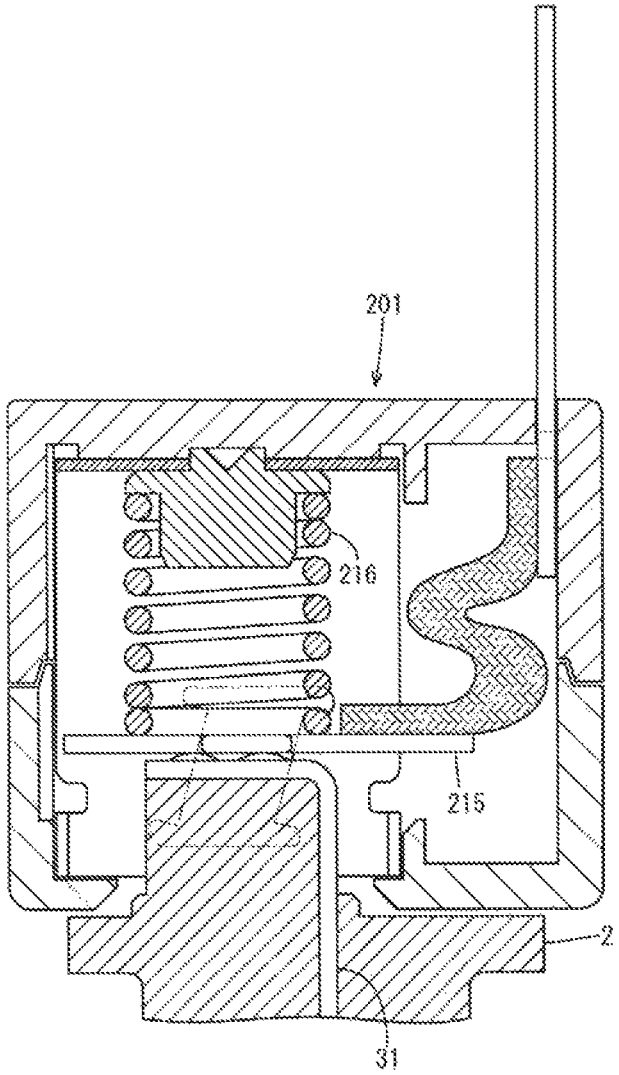
FIG. 15 is a section showing the connector and the mating connector in a connected state.

When the connector 201 and the mating connector 2 approach each other farther, as shown in FIG. 15, the connector 201 and the mating connector 2 are connected.

When the connector 201 and the mating connector 2 are disconnected for maintenance or another reason (i.e. when the electrical contact member and the mating contact point 31 are brought out of contact), right ends (another example of the slide-contact part) of the protrusions 225 slide in contact with the second folded portions 224B (second guide thereby being guided to positions shifted left from positions before disconnection. Thus, the electrical contact 215 returns to a position before the movement (position before moving up by being pressed by the mating contact point) in the vertical and lateral directions.

(2-4) Effects of Embodiment

According to the terminal fitting 210 of the second embodiment, the slide-contact parts (i.e. left ends of the protrusions) of the electrical contact 215 are guided to the positions shifted rightward (i.e. direction orthogonal to the inserting direction of the mating contact point 31) from the positions before the movement by the first folded portions 224A. This shifting phenomenon ensures that the spherical portions 33 of the mating contact point 31 rub the electrical contact member 215. Even if foreign substances adhere to the lower surface of the electrical contact 215 or the spherical portions 33, those foreign substances are scraped off. As just described, the electrical contact 215 need not be deformed resiliently to scrape off foreign substances. Therefore the plate thickness of the electrical contact 215 can be increased according to a current value.

Further, the first folded portions 224A (first guide) and the second folded portions 224B (second guide are on the inner wall surfaces of the guide holes 223 provided in the side walls 220 of the metal case 212. Specifically, upper sides (front sides in the inserting direction of the mating contact point) of the first folded portions 224A and upper ends of the second folded portions 224B are coupled via the side walls 220 of the metal case 212 and lower sides (rear sides in the inserting direction of the mating contact point) of the first folded portions 224A and lower ends of the second folded portions 224B are coupled via the side walls 220 of the metal case 212. Thus, the first and second folded portions 224A, 224B are not opened in the horizontal direction (direction orthogonal to the inserting direction of the mating contact point) by sliding-contact forces of the protruding portions 225.

The first folded portions 224A (first guide) have curved surfaces by being bent at 90° or more. Thus, the protrusions 225 slide in contact with those curved surface, and the protrusions 225 can be guided more smoothly.

The second folded portions 224B (second guide) have curved surfaces by being bent at least 90°. Thus, the protrusions 225 slide in contact with those curved surfaces, and the protrusions 225 can be guided more smoothly Third Embodiment A third embodiment is described with reference to FIG. 16.

Figure 16:
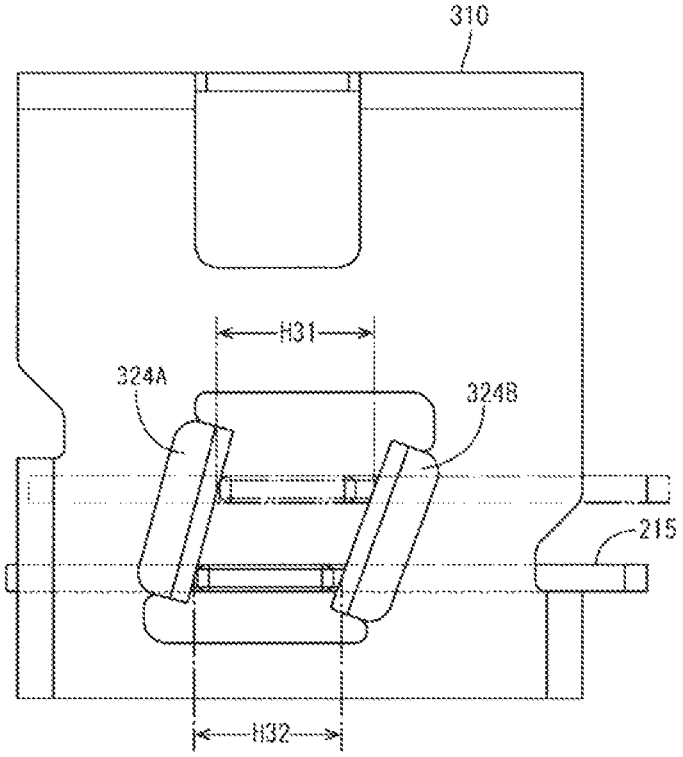
FIG. 16 is a side view of a terminal fitting according to a third embodiment viewed from front.

The third embodiment is a modification of the second embodiment. In the second embodiment described above, the first folded portion 224A (first guide) and the second folded portion 224B (second guide) are substantially parallel. In contrast, as shown in FIG. 16, a second folded portion 324A (second guide) is inclined more than a first folded portion 324A (first guide) in a terminal fitting 310 according to the third embodiment.

Thus, an interval H31 in a horizontal direction between the first and second folded portions 324A and 324B at a movement end position of an electrical contact 215 in a vertical direction (an example of the inserting direction of the mating contact point) is wider than an interval H32 in the horizontal direction between the first and second folded portions 324A and 324B at a position before moving up by being pressed by a mating contact point 31 (i.e. position before a movement).

The terminal fitting 310 is substantially the same as the terminal fitting 210 according to the second embodiment in other respects.

If a movement of the electrical contact member 215 in the horizontal direction (direction orthogonal to the inserting direction of the mating contact point) is restricted by the first and second folded portions 324A, 324B when the electrical contact member 215 is located at the movement end position in the vertical direction (inserting direction of the mating contact point) by being pressed by the mating contact point 31, the electrical contact member 215 cannot follow a movement of the mating contact point 31 and a deviation occurs at touching points if the mating contact point 31 moves in the horizontal direction due to thermal contraction or the like. If this is repeated, so-called fretting wear occurs and electrical resistance at the touching points may increase to generate heat.

In contrast, according to the terminal fitting 310 of the third embodiment, the interval H31 in the horizontal direction between the first and second folded portions 324A and 324B at the aforementioned movement end position is wider than the interval H32 in the horizontal direction between the first and second folded portions 324A and 324B at the position of the electrical contact 215 before the movement. Thus, if the mating contact point 31 moves in the horizontal direction, the electrical contact member 215 can follow the movement of the mating contact point 31. Therefore, a deviation is less likely to occur at the touching points and fretting wear can be suppressed.

Fourth Embodiment

Figure 17:
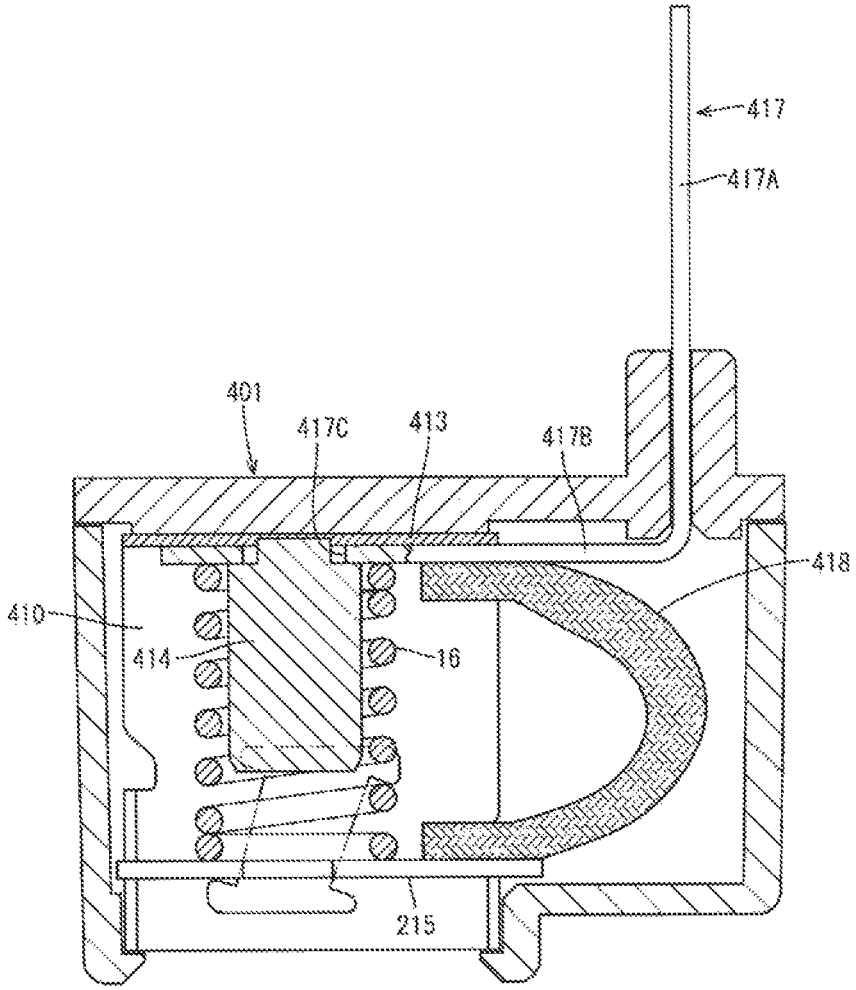
FIG. 17 is a section of a connector according to a fourth embodiment.

A fourth embodiment is described with reference to FIG. 17. The fourth embodiment is a modification of the third embodiment. As shown in FIG. 17, an intermediate terminal 417 according to the fourth embodiment is bent 90° and includes a vertical part 417A and a horizontal part 417B. The horizontal part 417B is formed with a through hole 417C into which a spring receiving portion 414 is to be inserted.

The horizontal part 417B is disposed between a ceiling wall 413 and a coil spring 216 of a terminal fitting 410 with the spring receiving portion 414 inserted in the through hole 417C. As shown in FIG. 17, the spring receiving portion 414 of the fourth embodiment has no flange, and the horizontal part 417B is pressed toward the ceiling wall 417 by the coil spring 16. One end of a braided wire 418 is connected to the lower surface of the horizontal part 417B Although the fourth embodiment is described as a modification of the third embodiment, the configuration of the intermediate terminal 417 of the fourth embodiment may be applied to the first or second embodiment.

Fifth Embodiment

Figure 18:
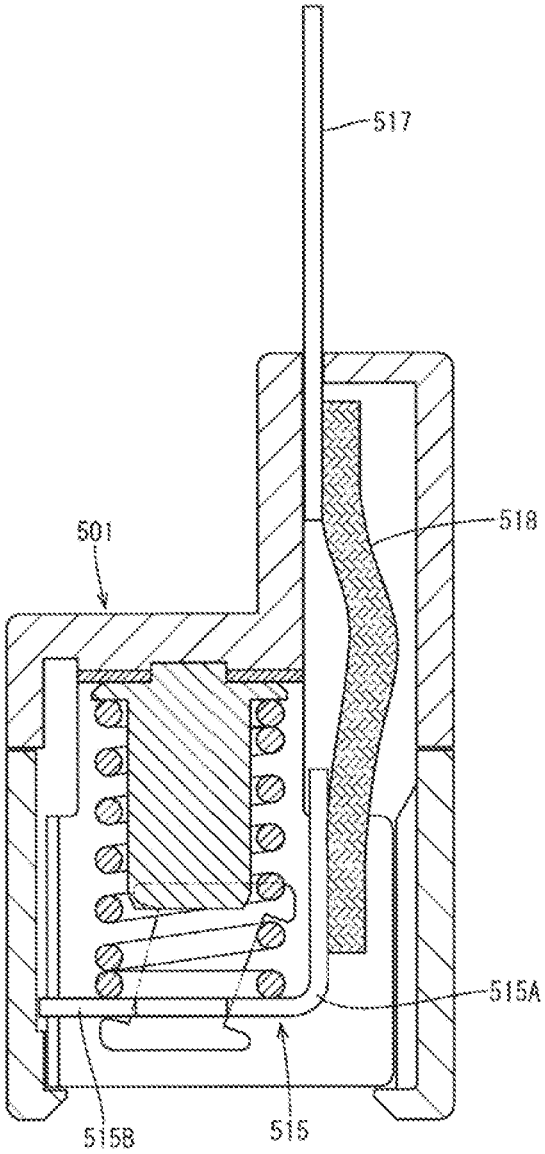
FIG. 18 is a section of a connector according to a fifth embodiment.

A fifth embodiment is described with reference to FIG. 18. The fifth embodiment is a modification of the third embodiment. As shown in FIG. 18, an intermediate terminal 517 according to the fifth embodiment has one end of a braided wire 518 connected to a rightward facing surface thereof. Further, as shown in FIG. 18, an electrical contact 515 of the fifth embodiment is bent at 90° and includes a vertical part 515A and a horizontal part 515B. The other end of the braided wire 518 is connected to a rightward facing surface of the vertical part 515A.

Although the fifth embodiment is described as a modification of the third embodiment, the configuration of the intermediate terminal 517 according to the fifth embodiment and the configuration of the electrical contact member 515 may be applied to the first or second embodiment.

Other Embodiments

The terminal module disclosed by this specification is not limited to the above described and illustrated embodiments. For example, the following embodiments are also included in the scope of the invention.

The first guides (parts 55A at both front and rear sides of the opening 57 of the front wall 55 of the metal case 52) linearly guide the slide-contact parts of the electrical contact members 53 to the oblique front side with respect to the inserting direction of the mating contact point 31 in the above first embodiment. However, the first guides may guide the slide-contact parts to positions shifted in the direction orthogonal to the inserting direction from the positions before the movement and are not limited to linearly guiding. For example, the first guides may guide the slide-contact parts along arcuate paths or may guide the slide-contact parts obliquely forward in a wavy manner.

Although the metal case 52 is provided with the first guides in the above first embodiment, the housing 51 may be provided with the first guides. In that case, the housing 51 is an example of the case and the connector 40 is an example of the terminal module.

Although the first and second guides include the folded portions in the above first embodiment, the folded portions may not necessarily be provided.

Although the intermediate terminal 17 and the braided wire 18 are provided in the above embodiments, these may not be provided. In that case, the electrical contact 53 may be connected to the outside by a wire or the like.

Although the braided wire 18 is used in the above embodiments, a flexible coated wire may be used instead of the braided wire 18. Further, although the braided wire 18 is disposed outside the metal case 52, it may be disposed in the metal case 52 or the coil spring 16.

In the second embodiment, the electrical contact 215 is provided with the protrusions 225 and the protrusions 225 are accommodated and guided in the guide holes 223 of the metal case 212. However, for example, recesses may be formed on edges of the electrical contact and, on the other hand, first guides may project on the side walls of the metal case 212, so that the first guides may be fit and guided in the recesses of the electrical contact 215.

Although only one coil spring 16 is provided in the above embodiments, two or more coil springs 16 may be provided.

(Although the coil spring 16 is used as a resilient member in the above embodiments, another resilient member such as high-strength rubber may be used.

In the third embodiment, the angle of inclination of the second folded portion 324B (second guide) is larger than that of the first folded portion 324A (first guide). In contrast, lower parts of the first and second guides may be parallel to each other and an upper part of the second guide may be inclined more than an upper part of the first guide to widen an interval. Specifically, the first and second guides may be partially parallel.

LIST OF REFERENCE SIGNS

16 . . . coil spring (example of resilient member)
17 . . . intermediate terminal
18 . . . braided wire
31 . . . mating contact point
40 . . . connector
50 . . . terminal fitting
51 . . . housing
52 . . . metal case (example of case)

52A . . . opening
53 . . . electrical contact,
55A . . . part on each of both front and rear sides of opening in front wall (example of first guide)
60 . . . folded portion (example of second guide)
70 . . . protruding portion (example of slide-contact part)
210 . . . terminal fitting
211 . . . housing
212 . . . metal case (example of case)
215 . . . electrical contact
216 . . . coil spring (example of resilient member)
217 . . . intermediate terminal
218 . . . braided wire
220 . . . side wall
221 . . . opening
223 . . . guide hole
224A . . . first folded portion (example of first guide portion)
224B . . . second folded portion (example of second guide portion)
225 . . . protrusion,
310 . . . terminal fitting,
324A . . . first folded portion (example of first guide)
324B . . . second folded portion (example of second guide)
410 . . . terminal fitting
417 . . . intermediate terminal
418 . . . braided wire
515 . . . electrical contact member
517 . . . intermediate terminal
518 . . . braided wire

The invention claimed is:

1. A terminal module, comprising:

a case including an opening through which a mating contact point is to be inserted;

a resilient member accommodated in the case; and an electrical contact biased toward the opening by the resilient member and configured to move while compressing the resilient member by being pressed by the mating contact point;

wherein:

the case includes a first guide configured to guide the electrical contact member to a position shifted from a position before a movement in a direction orthogonal to an inserting direction of the mating contact point by sliding in contact with the electrical contact when the electrical contact moves by being pressed by the mating contact point and a second guide configured to guide the electrical contact to the position before the movement by sliding in contact with the electrical contact when the electrical contact member guided to the shifted position moves toward the opening by being biased by the resilient member; and an interval in the direction orthogonal to the inserting direction between the first and second guides at a movement end position of the electrical contact member in the inserting direction is wider than an interval in the direction orthogonal to the inserting direction between the first and second guides at the position of the electrical contact member before the movement.

2. A terminal module according to claim 1, wherein:

the first and second guides are provided on inner wall surfaces of a guide hole provided in a side wall of the case; and the electrical contact includes a protrusion inserted in the guide hole and configured to slide in contact with the first and second guides.

3. A terminal module comprising:

a case including an opening through which a mating contact point is to be inserted;

a resilient member accommodated in the case; and an electrical contact biased toward the opening by the resilient member and configured to move while compressing the resilient member by being pressed by the mating contact point;

wherein:

the case includes a first guide configured to guide the electrical contact to a position shifted from a position before a movement in a direction orthogonal to an inserting direction of the mating contact point by sliding in contact with the electrical contact when the electrical contact moves by being pressed by the mating contact point and a second guide portion configured to guide the electrical contact member to the position before the movement by sliding in contact with the electrical contact when the electrical contact guided to the shifted position moves toward the opening by being biased by the resilient member;

the first and second guide portions are provided on inner wall surfaces of a guide hole provided in a side wall of the case;

the electrical contact member includes a protruding portion inserted in the guide hole and configured to slide in contact with the first and second guides; and the first guide includes a first folded portion protruding from the inner wall surface and bent at 90° or more, and the protrusion slides in contact with the first folded portion.

4. A terminal module, comprising:

a case including an opening through which a mating contact point is to be inserted;

a resilient member accommodated in the case; and an electrical contact biased toward the opening by the resilient member and configured to move while compressing the resilient member by being pressed by the mating contact point;

wherein:

the case includes a first guide configured to guide the electrical contact to a position shifted from a position before a movement in a direction orthogonal to an inserting direction of the mating contact point by sliding in contact with the electrical contact when the electrical contact moves by being pressed by the mating contact point and a second guide configured to guide the electrical contact to the position before the movement by sliding in contact with the electrical contact when the electrical contact guided to the shifted position moves toward the opening by being biased by the resilient member;

the first and second guides are provided on inner wall surfaces of a guide hole provided in a side wall of the case;

the electrical contact includes a protrusion inserted in the guide hole and configured to slide in contact with the first and second guides; and the second guide includes a second folded portion protruding from the inner wall surface and bent at 90° or more, and the protrusion slides in contact with the second folded portion.

5. A terminal module according to claim 3, wherein:

the first guide linearly guides the electrical contact to an oblique front side with respect to the inserting direction.

6. A terminal module according to claim 3, wherein the first guide and the second guide are substantially parallel.

7. A terminal module according to claim 6, further comprising an intermediate terminal to be connected to an external device, wherein:

the electrical contact is connected to the intermediate terminal by a flexible braided wire.

8. A terminal module according to claim 3, wherein:

the first guide linearly guides the electrical contact to an oblique front side with respect to the inserting direction.

9. A terminal module according to claim 8, wherein the first guide and the second guide are substantially parallel.

10. A terminal module according to claim 9, further comprising an intermediate terminal to be connected to an external device, wherein:

the electrical contact is connected to the intermediate terminal by a flexible braided wire.

* * * * *